US005423173A

United States Patent [19]

Lemon et al.

[11] Patent Number: 5,423,173

[45] Date of Patent: Jun. 13, 1995

[54] FUEL INJECTOR AND METHOD OF OPERATING THE FUEL INJECTOR

[75] Inventors: Donald T. Lemon, Palm Beach Gardens, Fla.; Aaron S. Hu, Hartford, Conn.; Barry C. Schlein, Wethersfield, Conn.; Theodore G. Fox, Newington, Conn.

[73] Assignee: United Technologies Corporation, Hartford, Conn.

[21] Appl. No.: 99,668

[22] Filed: Jul. 29, 1993

[51] Int. Cl.[6] ..... F23R 3/36; F02C 3/30

[52] U.S. Cl. ..... 60/39.06; 60/39.463; 60/39.55; 60/742

[58] Field of Search ..... 60/39.463, 39.55, 742, 60/740, 748, 39.06; 239/400, 405, 406

[56] References Cited

U.S. PATENT DOCUMENTS

| | | | |
|---|---|---|---|
| 3,684,186 | 8/1972 | Helmrich | 239/400 |
| 3,917,173 | 11/1975 | Singh | 239/400 |
| 4,327,547 | 5/1982 | Hughes et al. | 60/39.463 |
| 4,342,198 | 8/1982 | Willis | 239/406 |
| 4,425,755 | 1/1984 | Hughes | 60/742 |
| 4,600,151 | 7/1986 | Bradley | 239/400 |
| 4,938,417 | 7/1990 | Halvorsen | 239/406 |
| 4,977,740 | 12/1990 | Madden et al. | 60/742 |

*Primary Examiner*—Timothy S. Thorpe
*Attorney, Agent, or Firm*—Gene D. Fleischhauer

[57] ABSTRACT

A fuel injector 28 utilizing air, a liquid fluid and a gaseous fluid is disclosed. Various construction details are developed to enhance mixing and reduce carbon monoxide emissions for a given level of nitrous oxide emissions. In one detailed embodiment, the fuel nozzle 28 has two radially spaced passages 68, 104 for air having swirlers 86, 114, a liquid fluid passage 57 for water therebetween and a gaseous fluid fuel passage 118 which injects fuel into one of the air passages.

25 Claims, 4 Drawing Sheets fig.2
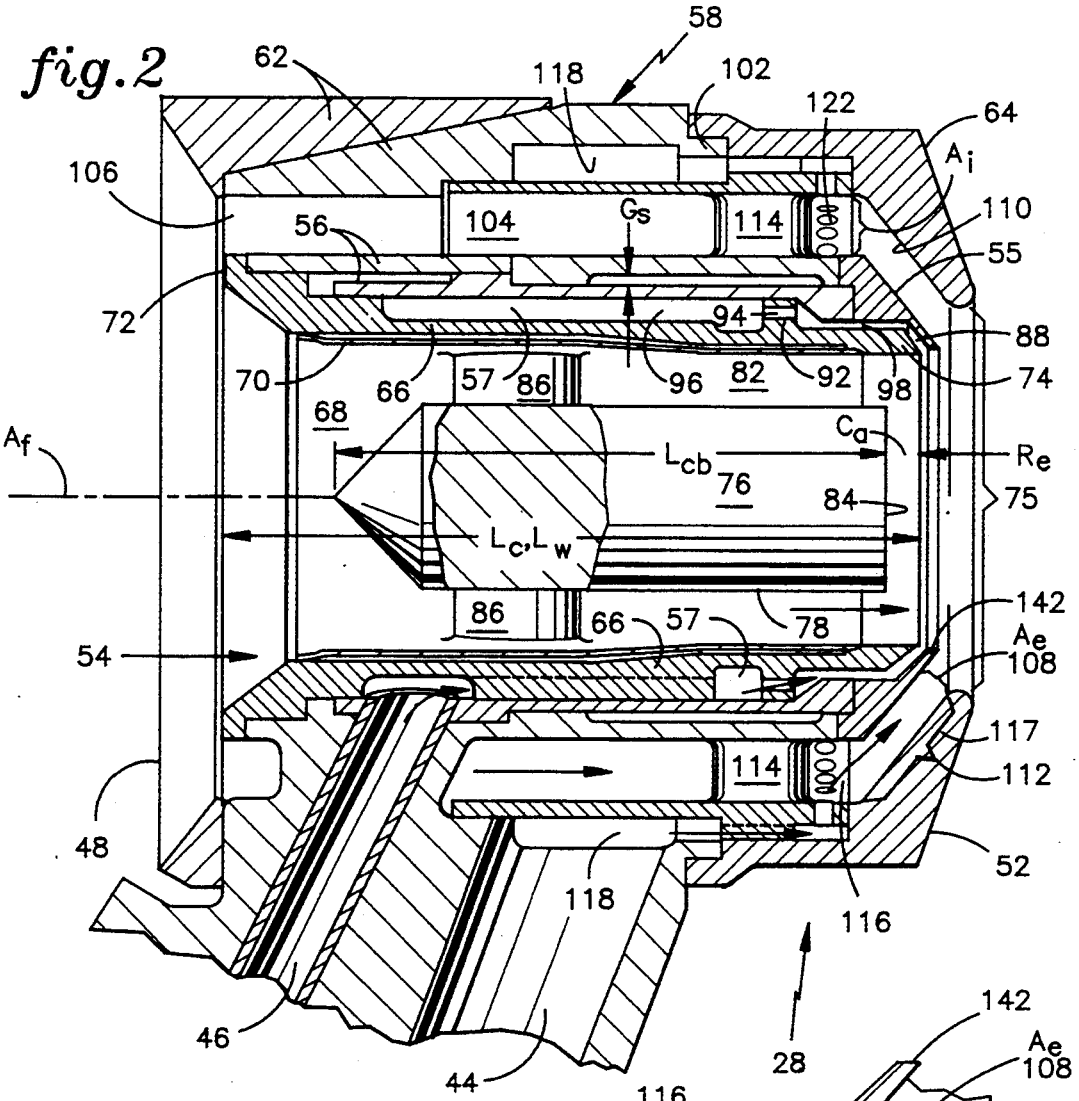
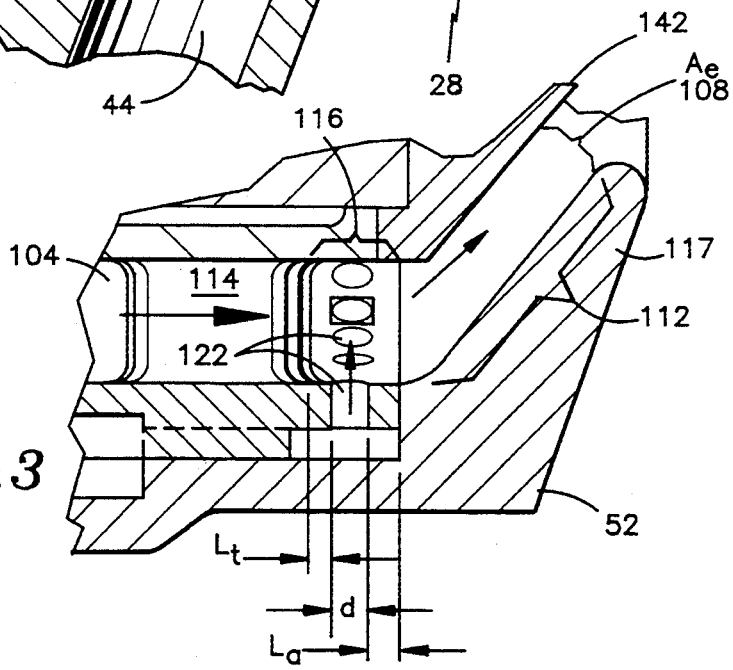
fig.3 fig. 4
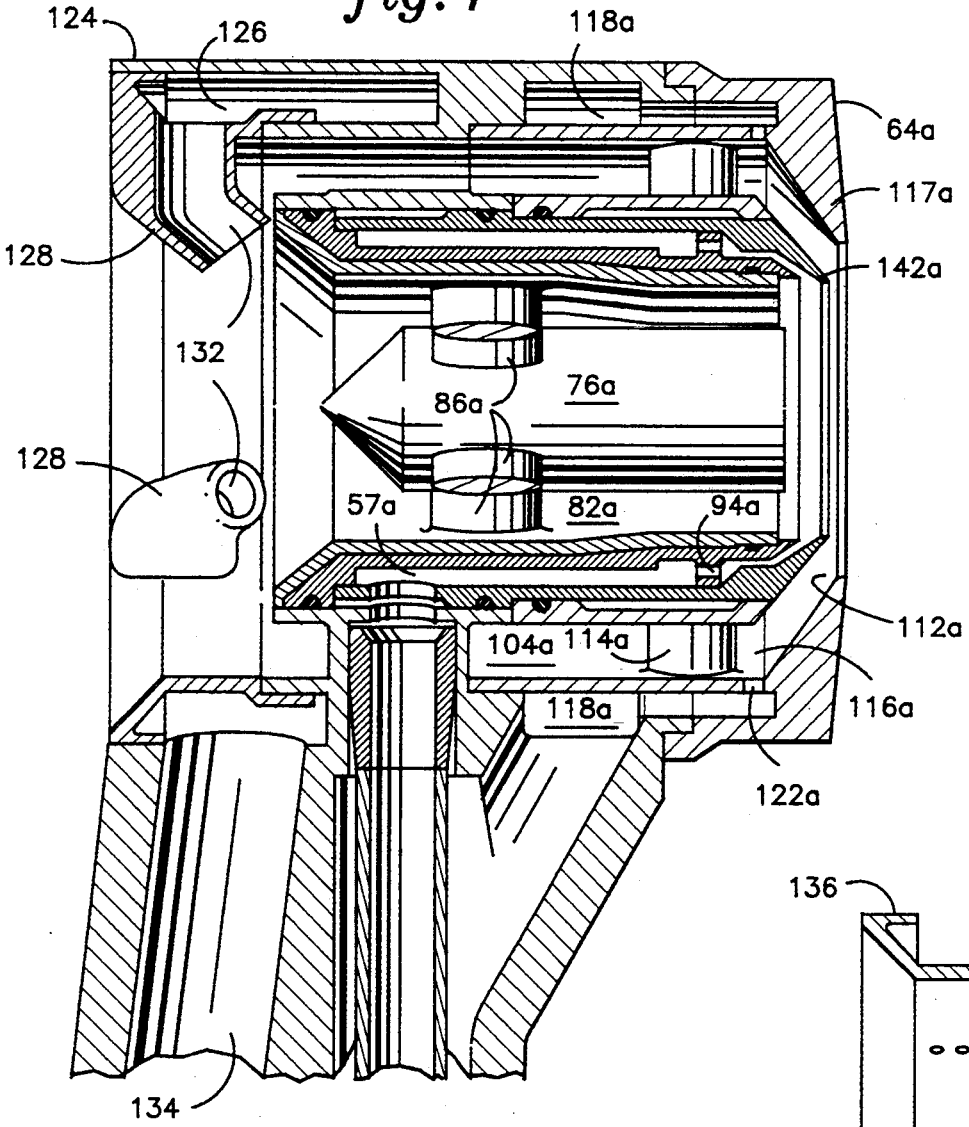
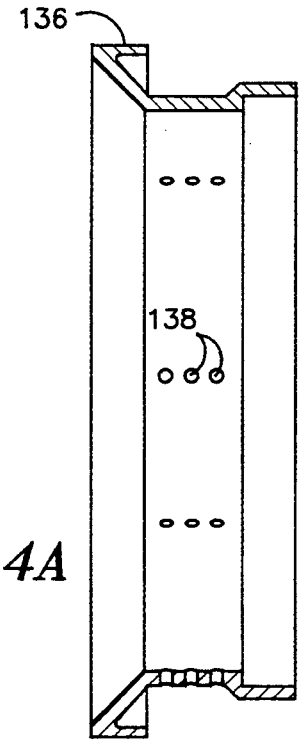
fig. 4A

FUEL INJECTOR AND METHOD OF OPERATING THE FUEL INJECTOR

TECHNICAL FIELD

This invention relates to an apparatus for injecting gaseous or liquid fuel into a combustion chamber with water in the gaseous form of steam or as a liquid. Although this invention was developed in the field of gas turbine engines, it is applicable to any machine having a flowpath for pressurized air which extends through a combustion chamber.

BACKGROUND ART

A typical axial flow, industrial gas turbine engine has a compression section, a combustion section, and a turbine section. An annular flowpath for working medium gases extends axially through the sections of the engine.

At the inlet to the compression section, the gases are primarily air. As the working medium gases are flowed along the flowpath, the gases are compressed in the compression section causing the temperature and the pressure of the gases to rise. The temperature of the gases exiting the compression section may exceed eight-hundred The hot, pressurized gases are flowed from the compression section to the combustion section. In the combustion section, the gases are mixed with fuel and are burned to add energy to the gases. These heated, high energy gases are expanded through the turbine section to produce useful work, such as by driving a turbine rotor that powers the compressor and by driving a second (or free) turbine which may be drivingly connected to a pump or electrical generator.

The combustion section includes one or more combustion chambers and a plurality of fuel injectors for supplying air and fuel to the combustion chambers. One example of a fuel injector is described in U.S. Pat. No. 4,377,618 which shows fuel discharged into an airstream so that mixing of the fuel and air takes place within an inner chamber. An annular second passage 68 outwardly of a first passage 62 provides a flowpath for air and water. A gaseous fuel is flowed through a third passage 44, 46 which is disposed radially outwardly of the first two passages.

Another example of a fuel injector is shown in U.S. Pat. No. 4,977,740 issued to Madden, Schlein, who is a co-inventor of the subject application and Wagner. U.S. Pat. No. 4,977,740 is assigned to the assignee of this application. In U.S. Pat. No. 4,977,740, two radially spaced passages form swirling columns of air. A liquid fluid passage is disposed between the air passages for injecting liquid fuel or water between the swirling airstreams. A gaseous fuel passage 116 is outwardly of the outermost air passage and provides for the independent injection of gaseous fuel or steam into the combustion zone downstream of the combustion chamber.

The above art notwithstanding, scientists and engineers are working under the direction of applicants assignee to further improve fuel injector assemblies, particularly of the type shown in U.S. Pat. No. 4,977,740 the material of which is incorporated herein by reference.

DISCLOSURE OF INVENTION

This invention is in part predicated on the recognition that providing premixing of gaseous fuel with a rotating column of air prior to mixing the column of air with a second column of air and a fluid such as water results in a combustion process which requires less water and therefore produces less carbon monoxide (CO) to achieve an acceptable level of nitrous oxide emissions. And, nearly the same result will occur utilizing the rotating airstream to intimately mix itself with steam prior to injection of steam into the region where the rotating streams of air are mixed together with fuel.

According to the present invention, a fuel injector having annular streams of rotating air for mixing the air with fuel and water supplied as a gaseous fluid and a liquid fluid, mixes the gaseous fluid (either fuel or steam) with one of the rotating airstreams prior to mixing both fluids together with both airstreams.

In accordance with one embodiment of the present invention, the fuel nozzle mixes gaseous fuel, in an outer passage for rotating the outer air stream, prior to mixing the rotating outer airstream with 1) an inner rotating airstream from a first inner passage and 2) liquid water from a second inner passage that is disposed between the two air passages.

In accordance with one detailed embodiment, the outer air passage has swirl means for imparting tangential velocity to the air and a mixing section downstream of the swirl means but upstream of an acceleration section in the passage to ensure intimate mixing of the gaseous fuel with the air after the gaseous fuel enters the mixing section.

A primary feature of the present invention is a fuel injector having a pair of radially spaced air passages. A liquid fluid passage is disposed between the air passages. Another feature is a gaseous fluid passage for injecting a gaseous fluid into one of the air passages. In one particular embodiment, the gaseous fluid passage is in flow communication with the outer air passage. The gaseous fluid passage may be in flow communication with a source of gaseous fuel or a source of gaseous water (steam). In another detailed embodiment, the fuel injector includes a passage for injecting steam primarily into the inner airstream, the outer airstream or into both the inner and outer air streams.

In one detailed embodiment, a particular feature is the swirl means in the air passage which receives the gaseous fluid and an acceleration section downstream of the swirl means. A mixing section is disposed between the acceleration section and the swirl means for receiving the gaseous fluid.

A primary advantage of the present invention is the level of carbon monoxide for a given level of nitrous oxide emissions which results from using a fuel injector to provide intimate premixing of gaseous fuel or steam with a swirling airstream in the fuel injector prior to further mixing with both gaseous and liquid fluids. Another advantage is the level of premixing which results from using an acceleration section in the fuel injector to accelerate the flow by contracting the flow area and moving the swirling flow to a smaller diameter to utilize the conservation of angular momentum to increase mixing. Another advantage is the durability of the fuel injector which results from avoiding ignition of the premixed fuel with the airstream by selecting the point of injection of the gaseous fuel and a location to avoid excessive residence time of the fuel and air mixture in the hot environment of the fuel injector.

The foregoing features and advantages of the present invention will become more apparent in light of the following detailed description of the best mode for carrying out the invention and in the accompanying drawing.

BRIEF DESCRIPTION OF DRAWINGS

FIG. 2 is a cross-sectional view of the fuel injector assembly shown in FIG. 1.

FIG. 3 is an enlarged cross-sectional view of a portion of the fuel injector assembly shown in FIG. 2.

FIG. 4 is a cross-sectional view of an alternate embodiment of the fuel injector shown in FIG. 2 having a separate passage for the injection of steam.

FIG. 4*a* is a cross-sectional view of an alternate embodiment of the means for injecting steam shown in FIG. 4.

BEST MODE FOR CARRYING OUT THE INVENTION

Figure 1:
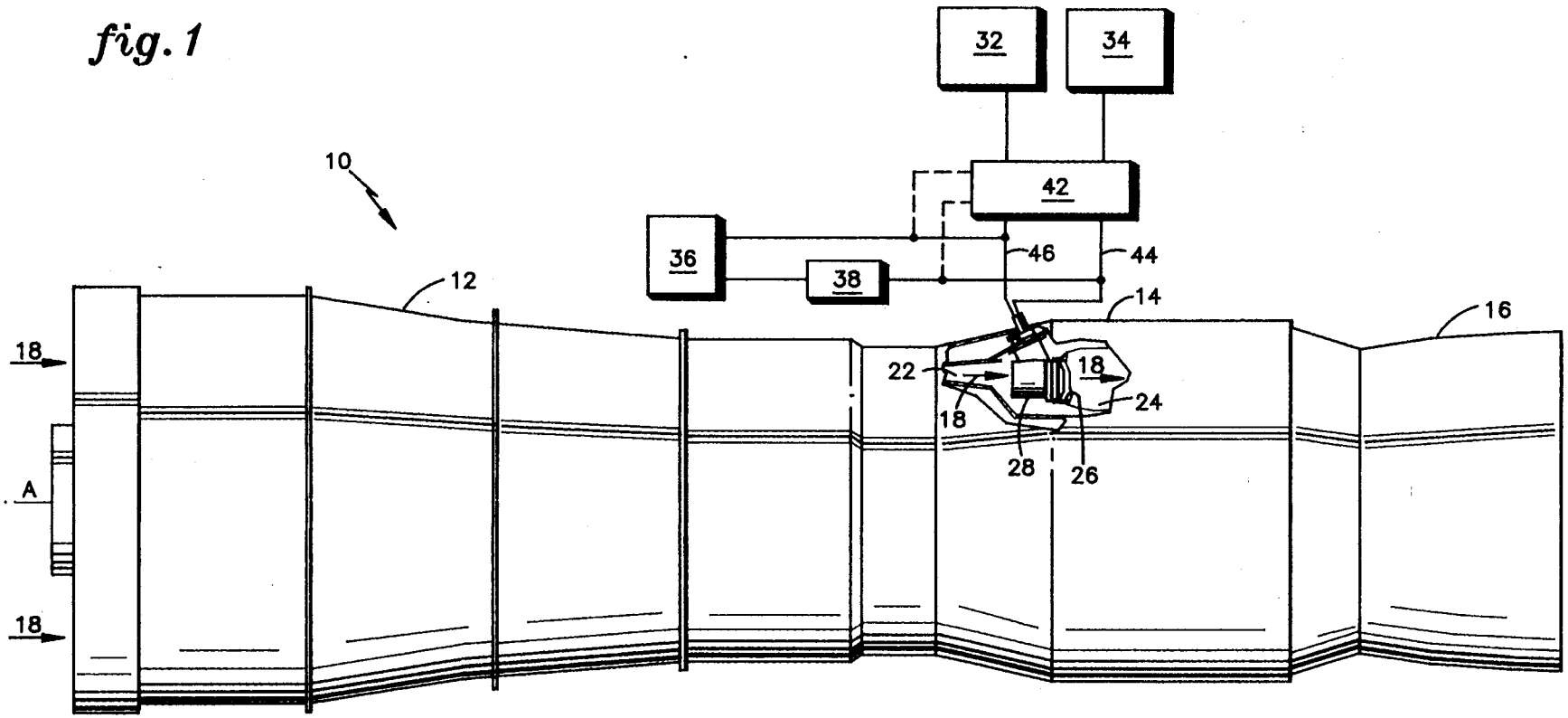
FIG. 1 is a side elevation view of an axial flow rotary machine showing a flowpath for working medium gases with part of the engine broken away to show a portion of the combustion section of the engine.
Figure 5:
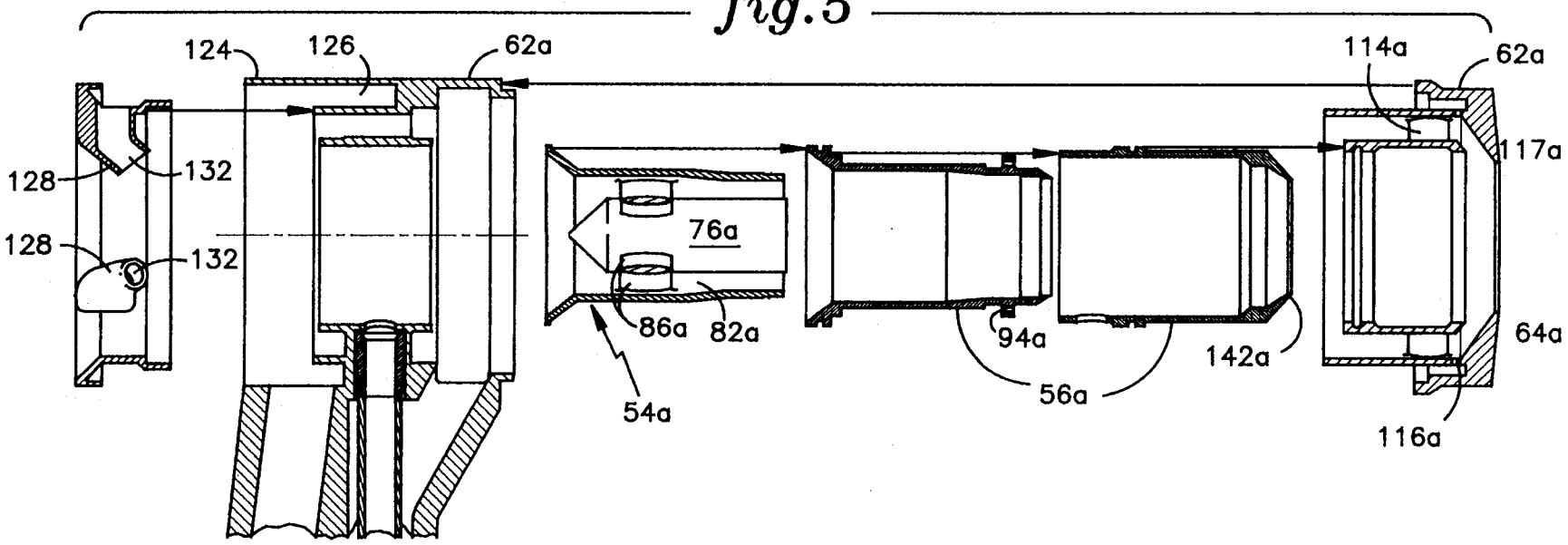
FIG. 5 is an exploded view of the fuel injector shown in FIG. 4.

FIG. 1 is a side elevation view of an axial flow rotary machine 10 of the industrial gas turbine engine type. The engine has an axis A. A compression section 12, a combustion section 14, and a turbine section 16 are disposed circumferentially about the axis A. An annular flowpath 18 for working medium gases extends circumferentially about the axis A and rearwardly through the sections of the engine.

The compression section 12 includes a diffuser region 22 which is immediately upstream of the combustion section 14. One or more combustion chambers, as represented by the combustion chamber 24 in the combustion section 14, extend axially downstream of the diffuser region. Each combustion chamber is adapted by one or more openings 26 to receive pressurized gases in the form of air from the diffuser region of the compression section. These gases are relatively hot in comparison to ambient temperature but are relatively cool with respect to the products of combustion which are formed in the combustion chamber.

A fuel injector, as represented by the fuel injector 28, is disposed in an associated opening 26 in the combustion chamber 24 to pass the pressurized gases (air) from the compression section to the combustion chamber and to inject fuel into the air after the air is discharged into the discharge region of the injector. An igniter (not shown) extends into the combustion chamber to ignite the mixture of fuel and air as the air passes from the discharge region of the fuel injector.

As shown in schematic fashion, the gas turbine engine is provided with fluids such as a source of liquid fuel 32, a source of gaseous fuel 34 and a source of water 36. A heat exchanger 38 is provided to provide a source of steam from the source of water. The steam is a gaseous fluid. The heat exchanger may be regeneratively heated by the hot gases discharged from the gas turbine engine.

An electronic fuel control 42, such as the fuel control Model Series DCS501 manufactured by the Woodward Governor Company, Fort Collins, Colo., controls the flow of liquid fuel and water to the fuel injector and a flow of gaseous fuel as the source of steam for supplying fuel or steam to the fuel injector. A first conduit means 44 is in flow communication with the fuel injector and is adapted to be in flow communication with the source of gaseous fuel the source of steam for supplying fuel or steam to the fuel injector. A second conduit means 46 is in flow communication with the fuel injector and is in flow communication with the source of liquid fuel and the source of water for supplying liquid fuel, water or a mixture of liquid fuel and water to the fuel injector.

FIG. 2 is an enlarged cross sectional view of the fuel injector 28 shown in FIG. 1. The fuel injector has an axis $A_f$, an upstream end 48 and a downstream end 52. The fuel injector includes an inner air supply means 54 having a smaller diameter at the downstream end and a larger diameter at the upstream end. A first outer wall 56 extends axially over the downstream end of the inner air supply means. The first outer wall has an outer surface 55 at the downstream end which is conical in shape and inclined toward the axis of $A_f$ of the fuel injector. The first outer wall is spaced radially from the inner air supply means 54 leaving a passage 57 for liquid fuel therebetween.

A casing 58 extends axially over the downstream end of the first outer wall and axially over the larger diameter portion of the upstream end of the inner air supply means 54. The casing has manifold sections 62 and a conical deflector section 64 which are integrally joined together to form a one-piece construction. Alternatively, these three sections might be formed as one piece.

The inner air supply means 54 includes an inner wall 66 extending circumferentially about the axis $A_f$ of the fuel injector leaving an inner air chamber 68 inwardly of the wall. The inner air chamber has a length $L_c$.

The inner wall includes a heat shield 70 which extends circumferentially about the inner wall to bound the inner air chamber and to shield the inner wall from the pressurized gases discharged from the compressor which are relatively hot in comparison to the liquid fuel in the liquid fuel passage 57. The inner wall 66 has an upstream end 72 is open to receiving air from an upstream location, such as the diffuser region 22 of the compression section 12. The inner wall as a downstream end 74 for discharging air into the discharge region 75 of the fuel injector.

The inner air supply means 54 includes a center body 76 which is solid and which is disposed entirely within the inner chamber 68. The center body extends axially in the inner chamber and has an axial length $L_{cb}$.

The center body 76 has an outer surface 78 which extends axially and which is spaced radially from the inner wall leaving a first annular passage 82 for air therebetween. The center body extends axially toward and into close proximity with the downstream end 74 of the inner wall 66. The center body has a downstream end surface 84 which extends radially to join the outer surface in blocking gases from entering the center body. Accordingly, the center body does not have a concave surface at the downstream end which would permit gases to enter the center body.

The downstream end surface 84 is spaced axially from the downstream end of the wall by a distance $C_a$, leaving a gap therebetween to provide a region of sudden expansion Re within the inner chamber for the air downstream of the center body. The axial gap $C_a$ may range from approximately 2% to 4% of the length of the inner air chamber $L_c$, but may, in some constructions be 10% of the length of the inner air chamber. The axial length $L_{cb}$ of the center body is greater than half the axial length of the inner wall $L_w$ or the inner chamber $L_c$. The preferred range for the length of the center body is seven tenths to nine tenths of the length $L_c$ of the inner chamber ($0.9 \geqq L_{cb}/L_c \geqq 0.7$). The preferred range for the area of the center body at the region of sudden expansion $R_e$ is two tenths to six tenths of the area of the inner air chamber at that location ($0.6 \geqq A_{cb}/A_c \geqq 0.2$).

A plurality of swirl vanes, as represented by the two swirl vanes 86, are disposed within the first passage at an axial location which is about midway between the upstream end 72 and the downstream end 74 of the inner wall. The swirl vanes extend between the heat shield 70 of the inner wall 66 and the center body 76 to support the center body. The swirl vanes provide means for imparting a tangential velocity to the air passing through the first passage 82. In other embodiments, the swirl vanes may extend through the heat shield to the adjacent structure of the inner wall. In the embodiment shown, the swirl vanes are at an angle which is approximately forty (40) degrees.

The first outer wall 56 is spaced radially from the inner wall 66 leaving the second annular passage 57 for liquid fuel therebetween. The first outer wall is hollow having an internal gap $G_s$ along an axial portion of the first outer wall adjacent to the second annular passage. The second annular passage 57 has a downstream end 88 for discharging liquid fuel into the discharge region of the fuel injector. An annular projection 92 from the inner wall 66 extends circumferentially between the inner wall and the first outer wall. A plurality of axially extending orifices 94 divide the liquid fuel passage into an upstream zone 96 and a downstream zone 98 and help meter the flow of fuel between the upstream zone and the downstream zone and into the discharge region 75.

The casing 58 has a second outer wall 102 spaced radially from the first outer wall 56 leaving a third annular passage for air 104 therebetween. The third annular passage has an upstream end 106 which is open to receiving air from the upstream location which is the discharge region 22 of the compression section 12. The third passage has a downstream end 108 for discharging air into the discharge region. The second outer wall 102 has an inner surface 110 at the downstream end 108. The inner surface faces the outer surface 55 of the first outer wall. The surface is conical in shape and is inclined toward the axis of the injector $A_f$. The third passage 104 has annular inlet area $A_i$ and an annular exit area $A_e$ as measured in a direction generally perpendicular to the passage and facing in the upstream direction. The annular cross sectional area decreases from a value $A_i$ to a value $A_e$ which is less than or equal to one-half of $A_i$. As a result, the third passage has a decreasing cross-sectional area adjacent at least one of said walls which forms an acceleration section 112 for accelerating the flow prior to entrance into the discharge region.

Means for imparting tangential velocity to the air passing through the second annular passage, as represented by the two canted swirl vanes 114, are disposed in the third annular passage. The swirl vanes are adjacent to the downstream end of the nozzle. The swirl vanes are spaced axially from the acceleration section of the third passage in the upstream direction, leaving a mixing section 116 therebetween.

The conical deflector section 64 of the casing includes a conical deflector 117 which is integrally joined to the casing. The conical deflector extends inwardly towards the axis $A_f$ of the injector to deflect the swirling air of the third annular passage 104 toward the liquid fuel discharged from the second annular passage 57.

A fourth annular passage 118 is disposed in the casing for discharging a gas into the third passage. The fourth passage is in flow communication with the mixing section 116 of the third passage at an axial location downstream of the tangential velocity means 114 and upstream of the acceleration section 112. The fourth passage has a plurality of circumferentially spaced orifices 122 which extend through the casing. The orifices are in flow communication with the mixing section 116 of the third annular passage.

FIG. 3 is an enlarged view of a portion of the fuel injector shown in FIG. 2. FIG. 3 shows the third annular passage 104, the swirl means 114, the mixing section 116, and a portion of the acceleration section 112.

The orifices 122 are sized to cause injection of the gas into the mixing region 116 with a component of velocity which extends in the radial direction. Each of said orifices is circular in cross-section and has a diameter d. Each orifice is in close proximity to the swirl vanes and acceleration section such that the distance $L_t$ from the orifice to the swirl (tangential velocity) means 114 and the distance $L_a$ from the orifice to the acceleration section are each less than or equal to the diameter or axial length of the orifice. As shown in phantom, the orifice might be a slot having an axial length greater than its circumferential width.

The first conduit means 44 is in flow communication with the fourth annular passage 118. The first conduit means is adapted to receive gaseous fuel from the source of gaseous fuel 34 and gaseous water (steam) from the source of steam 38. Under some operative conditions of the engine, it might be possible to flow only steam through the gaseous fuel passage. The second conduit means 46 extends across the third annular passage 104 for air to the second annular passage 57 for fuel. The second conduit means 46 is in the flow communication with the source of liquid fuel 32 and the source of water 36. The axial location of the second conduit means is adjacent to the upstream end 48 of the fuel injector to minimize the disruption of the circumferential flow of air in the air passage 104 prior to the air flow passing through the downstream swirl vanes 114.

FIG. 4A is a cross sectional view of an alternate embodiment **28*a* of the fuel injector shown in FIG. 2. Because of the similarity between the fuel injectors, the same numerals are used for the embodiment shown in FIG. 4 as are used in connection with FIG. 2 with the addition of the subscript a. Thus, the fuel injector in FIG. 2 has the numeral 28 and the fuel injector in FIG. 4 has the numeral 28*a***.

In addition to the elements shown in FIG. 2, the fuel injector **28*a* includes means 124 for flowing gaseous fluid into the first annular passage 82 which is the inner means for forming an annular stream of air rotating about the axis $A_f$ of the fuel injector. The means 124 includes an annular passage 126 which extends circumferentially about the fuel injector. A plurality of circumferentially spaced local ducts 128 extend across the third annular passage for air 104*a*. Each duct 128 has an orifice 132 for discharging a gaseous fluid such as steam into the inner air chamber 68*a*. The means 124 is in flow communication with a source of steam through the conduit 134. This provides the capability of injecting an amount of steam into the inner cavity in addition to the steam in the fourth annular passage 118** for gaseous fluid. Under another operative condition the fourth annular passage might receive gaseous fuel.

FIG. 4*a* is a cross-sectional view of a second means 136 for injecting steam into the fuel injector. This is an alternate embodiment of the means 134 for injecting steam shown in FIG. 4. The means 136 includes a plurality of orifices in flow communication with the passage 126 in the casing 58*a* for steam. The means 136 has orifices 138 which are sized under operative conditions to inject steam primarily into the third annular passageway for air 104*a* or into the first annular passage 82*a* for air or into both passages for air.

During operation of the axial flow rotary machine 10, working medium gases are flowed along the working medium flowpath 18. The gases are in the form of air when discharged from the compressor into the diffuser region 22. The air enters the open upstream end 48 of the fuel injector passing through the first annular passage 82 and the third annular passage 104 to form two swirling columns of air which are radially spaced one from the other. The columns of air are swirling in the same direction in the embodiment shown. In alternate embodiments, the columns of air may swirl in different directions.

Depending on the operative condition, liquid fluid in the form of fuel or water or a mixture of fuel and water are flowed via the second annular passage 57 between these two columns. The heat shield 70 is disposed between the first annular passage and the second annular passage and the gap $G_s$ is in the first outer wall. These block the transfer of heat from the air in the first annular passage and the third annular passage to the liquid fuel and water in the second annular passage. The liquid fluid is directed toward the inner airstream by the conical deflector or filmer 142 at the downstream end of the first outer wall 56. The conical deflector 117 on the third outer wall deflects the outer air stream towards the fuel and/or water stream, causing a shearing action which atomizes the fluid and provides a good dispersion of the fluid in air. Combustion takes place downstream of this location.

Gaseous fluid is added via the fourth annular passage. For example, under one operative condition, gaseous steam may be added via the fourth annular passage to the atomized liquid fuel. Alternatively, under other operative conditions, gaseous fuel may be the only fuel supplied outwardly of the inner swirling airstream. Under this condition, only water is flowed through the second annular passage. The water is dispersed by the co-rotating airstreams after the gaseous fuel is premixed with the outer airstream.

As can be seen, the design of the nozzle is compact and provides for operation of the fuel injector with premixed air and gaseous fuel from the fourth passage and from the second passage water, or fuel, or a mixture of water and fuel. Alternatively, the fourth passage might be used to add steam which is premixed with the outer airstream. The air-stream mixture is then mixed with the atomized fuel, water, or mixtures of water and fuel, supplied via the second passage.

A particular advantage of this construction is the addition of gas via the mixing section 116 which is in flow communication via the orifices 122 with the gaseous fuel or the gaseous steam. As the pressurized air entering the swirl means 114 is urged in the tangential direction, the air is compressed by reason of the contraction in area of the third annular passage which results from the presence of the swirl vanes 114. The swirling air expands into the mixing section 116 decreasing the momentum of the air to enable better penetration of the airstream by the jets of gaseous fuel or steam entering via the orifices 122. In the embodiment shown, the orifices are sized under operative conditions to cause the jets of fuel or steam to extend at least halfway across the third annular passage for air. Injection of fuel at this location takes advantage of the pressure drop across the swirl means 114 to avoid back-flow of the combustible mixture into the third annular passageway. Avoiding back-flow avoids the gaseous fuel having a higher residence time in this region of the fuel injector which might result in ignition of the combustible fuel and air mixture at this location with damage to the fuel injector.

As the mixture of gaseous fuel and air leaves the mixing section 116 of the third annular passage and enters the acceleration section 112, the flow rapidly accelerates. This rapid acceleration of flow results from a decrease in area of the third annular passage in the acceleration section and the movement of the flow as a free vortex with irrotational motion to a smaller radius. The decrease in area and the conservation of annular momentum rapidly accelerates the flow as it rotates in a helical fashion about the axis $A_f$ of the fuel injector. Rapid mixing occurs and separation of the flow from the walls of third annular passages is avoided, This is beneficial because separation could result in recirculation, allowing the fuel-air mixture to increase its residence time. Thus, avoiding separation avoids the increased possibility of the premature ignition in the fuel injector.

Experimental results have shown that premixing the gaseous fuel with air prior to mixing the carrier airstream with water from the second passage and air from the first rotating airstream decreases the amount of water needed to achieve an acceptable level of nitrous oxide emissions in comparison to equivalent constructions which do not premix the gaseous fuel and air. As a result, less water is required for the same level nitrous oxide emissions. This results in a reduction in the amount of carbon monoxide formed in the combustion process. Thus, this construction particularly enhances the low emission performance of the burner. Nearly the same result will obtain by more effectively mixing the steam with the air under those operative conditions in which: steam is injected via the fourth annular passage; and, fuel or a fuel and water mixture is injected via the second annular passage.

Good mixing will occur, utilizing the alternate embodiment shown in FIG. 4 and FIG. 4*a* which mix the gaseous steam with either the inner swirling airstream or the outer swirling airstream.

As with the parent fuel injector shown in U.S. Pat. No. 4,977,740, either fuel injector is easily assembled by integrally joining the manifold section 62 to the conical deflector section 64 to form the first casing module. The casing module is slidable with respect to the inner wall 66 and the first outer wall 56. Assembly is further enhanced by the modularity of the inner air supply means 54 which includes the inner wall 66 and its heat shield 70, and the center body 76 and swirl vanes 86 which may be fabricated as a unit. The swirl vanes 86 may engage the heat shield 70 or the inner wall 66. Should the vanes engage the heat shield 70, the contracting nature of the inner wall 66 will provide retention of the swirl vanes should the swirl vanes separate for any reason from the heat shield.

During assembly, the inner air supply means may be fabricated as one-piece construction and the casing and conical deflector assembled as another one-piece construction. The first outer wall 56 is slidable over the inner air supply means and the casing is slidable over the first outer wall to provide the assembled configuration. Thereafter, the first and second conduits are inserted through the casing to complete the construction. In the alternate embodiment the third conduit and either the means 124 or 136 are added to the casing to supply steam.

Although the invention has been shown and described with respect to detailed embodiments thereof, it should be understood by those skilled in the art that various changes in form and detail thereof may be made without departing from the spirit and scope of the claimed invention.

We claim:

1. A fuel injector for an engine having passages for air, for a liquid fluid and for a gaseous fluid, the fuel injector extending circumferentially about an axis and having a discharge region downstream of the injector, which comprises:

means for forming a first annular stream of air rotating about the axis and for discharging the stream into the discharge region, and for directing the stream in a first direction;

means for forming a second annular stream of air rotating about the axis and for discharging the stream into the discharge region, and for directing the stream in a second direction toward the first annular stream, the first annular stream being spaced radially from the second annular stream over at least a portion of its axial extent;

means for flowing the liquid fluid through the injector between the two rotating streams prior to discharge from the injector into the discharge region and for discharging the liquid fluid between the rotating streams into the discharge region; and, means for flowing the gaseous fluid into one of said streams of air prior to mixing of the stream of air and gaseous fluid with the liquid fluid or the other said stream of air;

wherein one of said fluids is fuel in the appropriate state and the other of said fluids is water in the appropriate state and wherein the mixing between said air and said gaseous fluid prior to mixing with the liquid fluid results in a more uniform mixture for combustion.

2. The fuel injector of claim 1 wherein the gaseous fluid is fuel.

3. The fuel injector of claim 1 wherein the liquid fluid is at least in part fuel and the gaseous fluid is water in the form of steam.

4. The fuel injector of claim 3 wherein the liquid fluid is a mixture of fuel and water.

5. The fuel injector of claim 3 wherein the fuel first annular stream of air is radially inwardly of the second annular stream of air and wherein the means for flowing gaseous fluid into one of said air streams is means for flowing steam and is in flow communication with the first (inner) air stream.

6. The fuel injector of claim 5 wherein the fuel injector has an upstream end, a downstream end, an inner air chamber, an inner wall which extends circumferentially to bound the inner air chamber, a center body disposed within the inner air chamber and spaced radially from the inner wall to leave an annular passage for the first stream of air therebetween an outer wall spaced radially from the inner wall leaving a second annular passage therebetween, for the second stream of air which is bounded in part by the outer wall and wherein the means for flowing steam has a circumferentially extending passage for steam bounded in part by the outer wall and has a plurality of ducts spaced circumferentially about the upstream end of the fuel injector upstream of the center body which are in flow communication with the annular passage for the first stream of air and the annular passage for steam.

7. The fuel injector of claim 3 wherein the first annular stream of air is radially inwardly of the second annular stream of air and wherein the means for flowing gaseous fluid into one of said air streams is means for flowing steam and is in flow communication with the second (outer) air stream.

8. The fuel injector of claim 3 wherein the second annular stream of air is radially outwardly of the first annular stream of air, wherein the fuel injector further has an angular passage which bounds the second annular stream of air, wherein the passage has a mixing section which is in flow communication with the source of gaseous fluid and wherein the annular passage has swirl means for imparting a tangential component of velocity to the air which is upstream of the mixing section.

9. The fuel injector of claim 8 wherein the swirl means is a plurality of swirl vanes.

10. The fuel injector of claim 8 wherein the passage has an acceleration section downstream of the mixing section which is convergent in area and inclined toward the axis of the fuel injector.

11. The fuel injector of claim 10 wherein the annular passage for air is bounded in part by an outer wall and wherein a plurality of circumferentially spaced orifices place the mixing section in flow communication with the source of gaseous fluid.

12. The fuel injector of claim 11 wherein the orifices are curvilinear in cross section as measured perpendicular to the direction of flow of the gaseous fluid.

13. The fuel injector of claim 12 wherein the orifices are circular in cross section.

14. The fuel injector of claim 11 wherein the orifices are slots having an axial length which is greater than the circumferential width.

15. The fuel injector of claim 11 wherein the swirl means and the acceleration section are spaced axially from the orifices by a distance which is no greater than the axial length of the orifice.

16. The fuel injector of claim 11 wherein the source of gaseous fluid is a source of steam.

17. The fuel injector of claim 11 wherein the source of gaseous fluid is a source of fuel.

18. A fuel injector for a gas turbine engine, having passages for a liquid fuel and a gaseous fuel extending circumferentially about an axis, the injector having a discharge region downstream of the injector which comprises:

an inner wall extending circumferentially about the axis leaving an inner air chamber inwardly of the wall, the inner air chamber having an upstream end which is open to receiving air from an upstream location and a downstream end for discharging air into the discharge region, an axially extending center body which is disposed in the inner chamber, the center body having an outer surface which extends axially and which is spaced radially from the inner wall leaving a first annular passage for air therebetween, the center body having a downstream end surface which extends radially to join the outer surface and block gases from entering the center body, the downstream end surface being spaced axially from the downstream end of the wall leaving a gap $C_a$ therebetween to provide a region of sudden expansion downstream of the center body within the inner chamber;

means for imparting a tangential velocity to the air passing through the first passage, which is disposed within the first passage;

a first outer wall spaced radially from the inner wall leaving a second annular passage for liquid therebetween, the liquid passage having a downstream end for discharging liquid into the discharge region, the first outer wall having an outer surface at the downstream end which is conical in shape and inclined toward the axis of the engine;

a casing having a second outer wall spaced radially from the first outer wall leaving a third annular passage for air therebetween, the third passage having an upstream end which is open to receiving air from an upstream location and a downstream end for discharging air into the discharge region, the second outer wall having an inner surface at the downstream end which faces the outer surface of the first outer wall and which is conical in shape and inclined toward the axis of the engine, the third passage having a decreasing cross-sectional area adjacent at least one of said walls to form an acceleration section for accelerating the flow prior to entrance into the discharge region, the annular cross sectional area decreasing from a value $A_i$ to a value $A_e$ which is less than or equal to one-half of $A_i$;

means for imparting a tangential velocity to the air passing through the third annular passage, which is disposed within the third passage at an axial location which is adjacent to the axial location of the downstream end of the inner wall and is spaced axially from the acceleration section of the third passage in the upstream direction, leaving a mixing region therebetween;

a fourth annular passage disposed in the casing for discharging a gas into the third passage, the fourth passage being in flow communication with the mixing region of the third passage at an axial location downstream of the tangential velocity means and upstream of the acceleration section, the fourth passage having a plurality of circumferentially spaced orifices which are sized to cause injection of the gas into the mixing region with a component of velocity which extends in the radial direction, each of said holes being circular in cross-section and having a diameter d and in close proximity to the swirl means and acceleration section such that the distance $L_t$ from the orifice to the tangential velocity means and the distances $L_a$ from the orifice to the acceleration section are less than or equal to the diameter of the orifice;

a first conduit means which is in flow communication with the fourth annular passage and which is adapted to be in flow communication with at least one source of gas;

a second conduit means extending across the third annular passage for air to the second annular passage for liquid which is in flow communication with the second annular passage and which is adapted to be in flow communication with a source of liquid;

wherein gas which is injected at a plurality of locations of the orifices of the fourth annular passage of into air in the third annular passage is mixed in the acceleration section of the third annular mixing section and then further mixed in the passage under conditions of accelerating flow to avoid separation and recirculation regions prior to injection of the air-gas mixture into the discharge region, the accelerating flow resulting from the decrease in cross sectional area of the third passage and the inclination of the third passage toward the axis of the nozzle.

19. The fuel injector of claim 18 wherein the fourth annular passage is in flow communication with a source of gaseous fuel and the second annular passage is in flow communication with a source of water.

20. The fuel injector of claim 18 wherein the fourth annular passage is in flow communication with a source of gaseous fuel and the second annular passage is in flow communication with a source of water.

21. The fuel injector of claim 18 wherein the fourth annular passage is in flow communication with a source of gaseous fuel and the second annular passage is in flow communication with a source of fuel.

22. The fuel injector of claim 18 wherein the fourth annular passage is in flow communication with a source of steam and the second annular passage is in flow communication with a source of water.

23. The fuel injector of claim 18 wherein the fourth annular passage is in flow communication with a source of steam and the second annular passage is in flow communication with a source of water and fuel.

24. The fuel injector of claim 18 wherein the fourth annular passage is in flow communication with a source of steam and the second annular passage is in flow communication with a source of fuel.

25. A method of operating a fuel injector for a gas turbine engine having passages for air, for a liquid fluid and for a gaseous fluid, the fuel injector extending circumferentially about an axis and having a discharge region downstream of the injector, which comprises:

forming a first annular stream of air rotating about the axis and for discharging the stream into the discharge region, and for directing the stream in a first direction;

forming a second annular stream of air rotating about the axis and for discharging the stream into the discharge region, and for directing the stream in a second direction toward the first annular stream, the first annular stream being spaced radially from the second annular stream over at least a portion of its axial extent;

flowing the liquid fluid through the injector between the two rotating streams prior to discharge from the injector into the discharge region and for discharging the liquid fluid between the rotating streams into the discharge region; and, flowing the gaseous fluid into one of said streams of air prior to mixing of the stream of air and gaseous fluid with the liquid fluid or the other said stream of air; wherein one of said fluids is fuel in the appropriate state and the other of said fluids is water in the appropriate state and wherein the mixing between said air and said gaseous fluid prior to mixing with the liquid fluid results in a more uniform mixture for combustion.

* * * * *